US011197081B2

(12) United States Patent
Sun et al.

(10) Patent No.: US 11,197,081 B2
(45) Date of Patent: Dec. 7, 2021

(54) METHOD FOR DETERMINING CONFIGURATION PARAMETER AND EARPHONE

(71) Applicant: BEIJING XIAOMI MOBILE SOFTWARE CO., LTD., Beijing (CN)

(72) Inventors: Changyu Sun, Beijing (CN); Wei Sun, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/891,470

(22) Filed: Jun. 3, 2020

(65) Prior Publication Data

US 2021/0211797 A1 Jul. 8, 2021

(30) Foreign Application Priority Data

Jan. 8, 2020 (CN) ..... 202010017425.9

(51) Int. Cl.
*H04R 1/10* (2006.01)
*H04R 29/00* (2006.01)

(52) U.S. Cl.
CPC ..... *H04R 1/1041* (2013.01); *H04R 1/1016* (2013.01); *H04R 29/001* (2013.01); *H04R 2430/01* (2013.01)

(58) Field of Classification Search
CPC ... H04R 1/1041; H04R 1/1016; H04R 29/001
See application file for complete search history.

(56) References Cited

U.S. PATENT DOCUMENTS

2010/0166218 A1* 7/2010 Saito ..... H03G 5/165 381/98
2010/0177910 A1 7/2010 Watanabe
2019/0212436 A1* 7/2019 Baheti ..... G01S 13/88

OTHER PUBLICATIONS

Partial European Search report for EP application 20182298.8, dated Nov. 25, 2020.

* cited by examiner

*Primary Examiner* — Simon King
(74) *Attorney, Agent, or Firm* — Syncoda LLC; Feng Ma

(57) ABSTRACT

A method for determining a configuration parameter includes: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

18 Claims, 9 Drawing Sheets

METHOD FOR DETERMINING CONFIGURATION PARAMETER AND EARPHONE

CROSS-REFERENCE TO RELATED APPLICATION

This application claims priority to Chinese Patent Application No. 202010017425.9 filed on Jan. 8, 2020, the disclosure of which is hereby incorporated by reference in its entirety.

BACKGROUND

Smart electronic devices have become an inseparably part of users' daily lives. When in public places or doing sports, users typically use earphones to establish connections with electronic devices to send and receive audio signals. Therefore, sound quality of the earphones may affect the user experience.

SUMMARY

The present disclosure generally relates to the field of terminal technologies, and more particularly to a method for determining a configuration parameter, and an earphone.

According to a first aspect of embodiments of the present disclosure, there is provided a method for determining a configuration parameter, which is applied in an earphone. The method includes: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

According to a second aspect of embodiments of the present disclosure, there is provided a non-transient computer readable storage medium having a computer instruction stored therein, wherein when the computer instruction is executed by a processor, the processor implements a method for determining a configuration parameter as described above.

According to a third aspect of embodiments of the present disclosure, there is an earphone, including: a memory having a computer instruction stored therein; and a processor that is configured to execute the computer instruction in the memory for implementing a method for determining a configuration parameter as described above.

It is to be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this disclosure, illustrate embodiments consistent with the present disclosure and, together with the description, serve to explain principles of various embodiments of the present disclosure.

DETAILED DESCRIPTION

Figure 1:
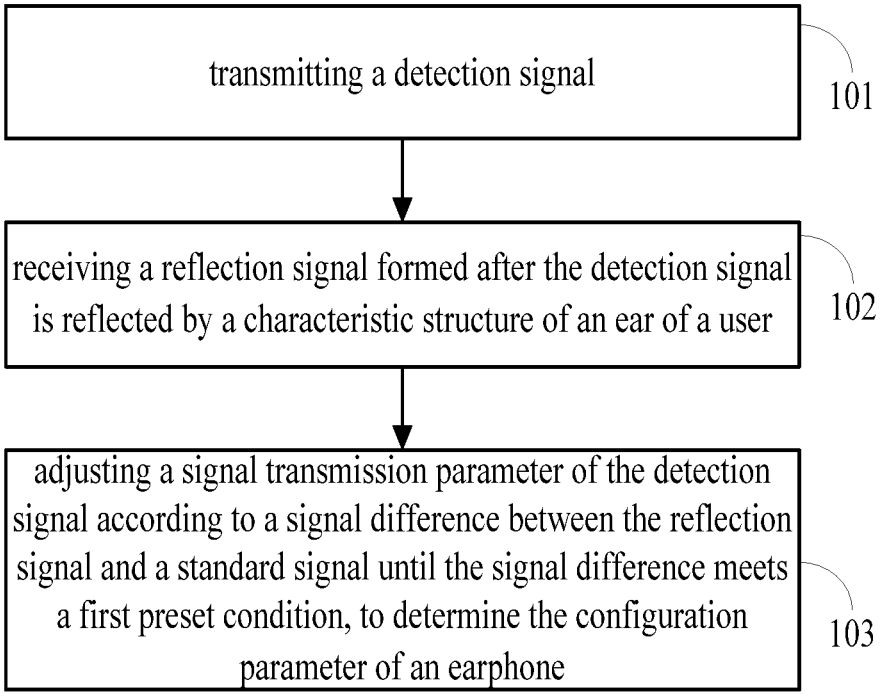
FIG. 1 is a flowchart of a method for determining a configuration parameter according to some embodiments of the present disclosure.

Reference will now be made in detail to some embodiments, examples of which are illustrated in the accompanying drawings. The following description refers to the accompanying drawings in which the same numbers in different drawings represent the same or similar elements unless otherwise represented. The implementations set forth in the following description of some embodiments do not represent all implementations consistent with the present disclosure. Instead, they are merely examples of apparatuses and methods consistent with aspects related to the present disclosure as recited in the appended claims.

It should be illustrated that, terms used in the present disclosure are only for the purpose of describing specific embodiments, but should not be construed to limit the present disclosure. As used in embodiments of the present disclosure and the appended claims, "a," "an" and "the" in singular forms mean including plural forms as well, unless clearly indicated in the context otherwise. It should also be understood that, as used herein, the term "and/or" represents and contains any one and all possible combinations of one or more associated listed items.

It should be understood that, terms "first," "second" and "third" as used in the description of the present disclosure, the appended claims and drawings are only used for distinguishing various information or different elements, rather than indicating a specific order. For example, without departing from the scope of the present disclosure, the first information may also be referred to as the second information. Similarly, the second information may also be referred to as the first information. Depending on the context, the word "if" as used herein may be interpreted as "when," "in a case that," or "determining . . . in response to."

According to a first aspect of embodiments of the present disclosure, there is provided a method for determining a configuration parameter, which is applied in an earphone. The method includes: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

In some embodiments, the earphone comprises a signal transmitter and a signal receiver, and transmitting the detection signal includes: instructing the signal transmitter to transmit the detection signal into the ear of the user and to the signal receiver respectively; acquiring the standard signal according to the detection signal received by the signal receiver.

In some embodiments, the signal difference includes: a phase difference between the reflection signal and the standard signal; and/or an amplitude difference between the reflection signal and the standard signal.

In some embodiments, adjusting the signal transmission parameter of the detection signal according to the signal difference between the reflection signal and the standard signal until the signal difference meets the first preset condition, to determine the configuration parameter of the earphone includes: adjusting the signal transmission parameter until the signal difference meets the first preset condition when the signal difference meets a second preset condition, wherein parameters of an equalizer and a dynamic range controller of the earphone corresponding to the signal transmission parameter at a time when the first preset condition is met are determined as the configuration parameter of the earphone.

In some embodiments, adjusting the signal transmission parameter of the detection signal according to the signal difference between the reflection signal and the standard signal until the signal difference meets the first preset condition, to determine the configuration parameter of the earphone further includes: adjusting the signal transmission parameter until the signal difference meets the second preset condition when the signal difference meets a third preset condition, wherein a volume of a sounding cavity of the earphone corresponding to the signal transmission parameter at a time when the second preset condition is met is determined as the configuration parameter of the earphone.

In some embodiments, the determination of the volume of the sounding cavity of the earphone corresponding to the signal transmission parameter at the time when the second preset condition is met as the configuration parameter of the earphone includes: driving a movable member in the sounding cavity to move according to the signal transmission parameter to change the volume of the sounding cavity.

In some embodiments, the method further includes: recognizing an identity of the user according to the configuration parameter.

In some embodiments, the method further includes: determining a wearing state of the earphone according to whether the reflection signal is received or not.

In some embodiments, the detection signal includes a millimetre-wave signal.

According to a second aspect of embodiments of the present disclosure, there is provided a non-transient computer readable storage medium having a computer instruction stored therein, wherein when the computer instruction is executed by a processor, the processor implements a method for determining a configuration parameter including: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

According to a third aspect of embodiments of the present disclosure, there is an earphone, including: a memory having a computer instruction stored therein; and a processor that is configured to execute the computer instruction in the memory for implementing a method for determining a configuration parameter including: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

In some embodiments, the earphone includes a sounding cavity; and a movable member disposed in the sounding cavity and connected to the sounding cavity in a sliding manner.

FIG. 1 is a flowchart of a method for determining a configuration parameter according to some embodiments of the present disclosure. The method shown in FIG. 1 is applicable to a terminal, and includes the following acts as illustrated at blocks of FIG. 1.

At block 101, a detection signal is transmitted.

In this embodiment, the detection signal may include an electromagnetic wave signal, for example, a millimeter-wave signal. The earphone includes a signal transmitter and a signal receiver. Specifically, the signal transmitter is configured to transmit the detection signal into the user's ear, and is connected to the signal receiver to transmit the detection signal to the signal receiver, to allow a microprocessor of the earphone to acquire a standard signal according to the detection signal received by the signal receiver.

At block 102, a reflection signal, that is formed after the detection signal is reflected by a characteristic structure of an ear of a user, is received.

In this embodiment, due to differences in ear structures of different users, for example, different auricles and different relative positions between an eardrum and the earphone, different reflection signals can be received after a same detection signal is transmitted to different users. According to the received reflection signals, the characteristic structure of the ear of the user can be estimated, so that the configuration parameter of the earphone can be adjusted to match the user, thus realizing the adaptive adjustment of the configuration parameter of the earphone.

At block 103, a signal transmission parameter of the detection signal is adjusted according to a signal difference between the reflection signal and a standard signal until the signal difference meets a first preset condition, to determine the configuration parameter of an earphone.

In this embodiment, the standard signal may be a reference signal pre-stored in the electronic device, or the standard signal may be acquired according to the detection signal transmitted from the signal transmitter of the earphone to the signal receiver. For example, the received detection signal may be directly determined as the standard signal, or the standard signal may be calculated according to the received detection signal and a preset algorithm. The preset algorithm is related to a loss in the process of transmitting the detection signal to the signal receiver, and may be specifically designed according to needs and thus is not particularly limited herein.

The configuration parameter may include a hardware configuration parameter and a software configuration parameter. For example, the hardware configuration parameter may include a volume of a sounding cavity of the earphone, and the sounding cavity may include a front cavity and a back cavity. The software configuration parameter may include a software parameter of an equalizer and a software parameter of a dynamic range controller. It should be noted that the configuration parameter is only illustrated in this embodiment, and in other embodiments it is possible to adjust other hardware configuration parameters or software configuration parameters, which are not limited in the present disclosure.

In this embodiment, the detection signal encounters the characteristic structure of the ear and then is reflected to the signal receiver. It takes a period of time to allow the signal receiver to receive the reflection signal, and the signal energy may be attenuated to a certain extent. When the signal transmitter directly transmits the detection signal to the signal receiver, an energy attenuation and required duration of the detection signal in this case may be different from the energy attenuation and the duration of the received reflection signal. On this basis, there may be a difference in phase and amplitude between the reflection signal and the standard signal. Therefore, the signal difference described in the above embodiment may include one or more of phase difference and amplitude difference, which is not limited in the present disclosure.

In some embodiments, after the detection signal is transmitted for the first time, if the difference between the received reflection signal and the standard signal meets a first preset condition, the signal transmission parameter of the detection signal transmitted for the first time may be used to determine a corresponding configuration parameter, and such a configuration parameter may be configured as a parameter of the earphone.

In some other embodiments, after the detection signal is transmitted for the first time, if the difference between the received reflection signal and the standard signal meets a second preset condition, the signal transmission parameter may be adjusted so that the signal difference gradually decreases until the signal difference between the reflection signal and the standard signal meets the first preset condition, and parameters of the equalizer and the dynamic range controller of the earphone corresponding to the signal transmission parameter at the time when the first preset condition is met are determined as the configuration parameter of the earphone. In the process of the signal difference from meeting the second preset condition to meeting the first preset condition, each time the signal transmission parameter is adjusted, the parameters of the equalizer and the dynamic range controller corresponding to the signal transmission parameter may be simultaneously adjusted, so as to configure the parameters of the equalizer and the dynamic range controller of the earphone. Alternatively, the parameters of the equalizer and the dynamic range controller corresponding to the signal transmission parameter at the time when the first present condition is met may be acquired when it is determined that the signal difference meets the first preset condition, so as to configure the parameters of the equalizer and the dynamic range controller of the earphone.

In a further embodiment, after the detection signal is transmitted for the first time, if the difference between the received reflection signal and the standard signal meets a third preset condition, the signal transmission parameter may be adjusted so that the signal difference gradually decreases until the signal difference between the reflection signal and the standard signal meets the second preset condition, and a volume of a sounding cavity of the earphone corresponding to the signal transmission parameter at the time when the second preset condition is met is determined as the configuration parameter of the earphone. In the process of the signal difference from meeting the third preset condition to meeting the second preset condition, each time the signal transmission parameter is adjusted, the volume of the sounding cavity corresponding to the signal transmission parameter may be simultaneously adjusted, so as to adjust the volume of the sounding cavity of the earphone to configure the parameter of the earphone. Alternatively, the volume of the sounding cavity of the earphone corresponding to the signal transmission parameter at the time when the second present condition is met may be acquired when it is determined that the signal difference meets the second preset condition, so as to adjust the volume of the sounding cavity of the earphone to configure the parameter of the earphone. A manner of the configuration of the parameters as described above is not particularly limited herein. Further, for the process of the signal difference from meeting the second preset condition to meeting the first preset condition, reference may be made to the foregoing embodiment, and details are not described herein again.

The volume adjustment of the sounding cavity of the earphone may be achieved by the following embodiments. In some embodiments, a spring in the sounding cavity may be controlled to compress or extend according to the signal transmission parameter, and a movable member disposed in the sounding cavity may be driven by the spring to move to change the volume of the sounding cavity. For example, the volume of the sounding cavity can be changed from large to small or from small to large. In some other embodiments, a motor assembly in the sounding cavity can be controlled to switch to an on/off state according to the signal transmission parameter, and a speed and a duration of the motor assembly may be further controlled to allow the motor assembly to drive the movable member disposed in the sounding cavity to a corresponding position, thus changing the volume of the sounding cavity.

It should be noted that the first preset condition, the second preset condition and the third preset condition are all used to characterize the amplitude difference and phase difference between the reflection signal and the standard signal, but to correspond to difference amounts (the smaller the difference is, the higher a degree of matching the configuration parameter of the earphone and the characteristic structure of the ear of the user is). Specifically, the third preset condition represents the largest difference, the first preset condition represents the smallest difference, and the second preset condition represents the middle difference. For example, the first preset condition may be that the phase difference $\Delta t1<t1$, the amplitude difference $\Delta J1<J1$, the third preset condition may be that the phase difference $\Delta t3>t2$, the amplitude difference $\Delta J3>J2$, and the second preset condition may be that t1<the phase difference $\Delta t2<t2$, J1<the amplitude difference $\Delta J2<J2$, where t1, t2, J1 and J2 may be acquired according to experiments, and are not limited herein.

In the above embodiments, due to slight differences of the characteristic structures of different users, there is also a difference between the configuration parameters finally determined for the different users who use the same earphone, so that the determined configuration parameter of the earphone may be used to recognize an identity of a user and avoid embezzling the earphone.

In addition, a wearing state of the earphone can also be determined according to whether the reflection signal reflected from the characteristic structure of the ear of the user is received. For example, when the reflection signal is received, the earphone is considered to be in a wearing state, and when the reflection signal is not received, it can be determined that the earphone is not worn, and the earphone can be turned down, muted or turned off to save the power of the earphone or reduce power loss caused by the earphone. The earphone may be any one of a wired earphone, a wireless earphone, a digital earphone, and an analog earphone, and is not limited herein.

With the above embodiments of the present disclosure, position and shape of characteristics of the ear structure can be know through the signal difference between the reflection signal reflected by the characteristic structure of the ear and the standard signal, and the signal difference between the reflection signal and the standard signal can be further reduced by adjusting the signal transmission parameter. When the signal difference is reduced to be small enough, a configuration parameter corresponding to the signal transmission parameter at this time may be determined as the configuration parameter of the earphone, so that the earphone can adaptively adjust the configuration parameter according to the characteristics of the user's ear, thus optimizing the sound quality that the user hears and improving the user's experience.

Figure 2:
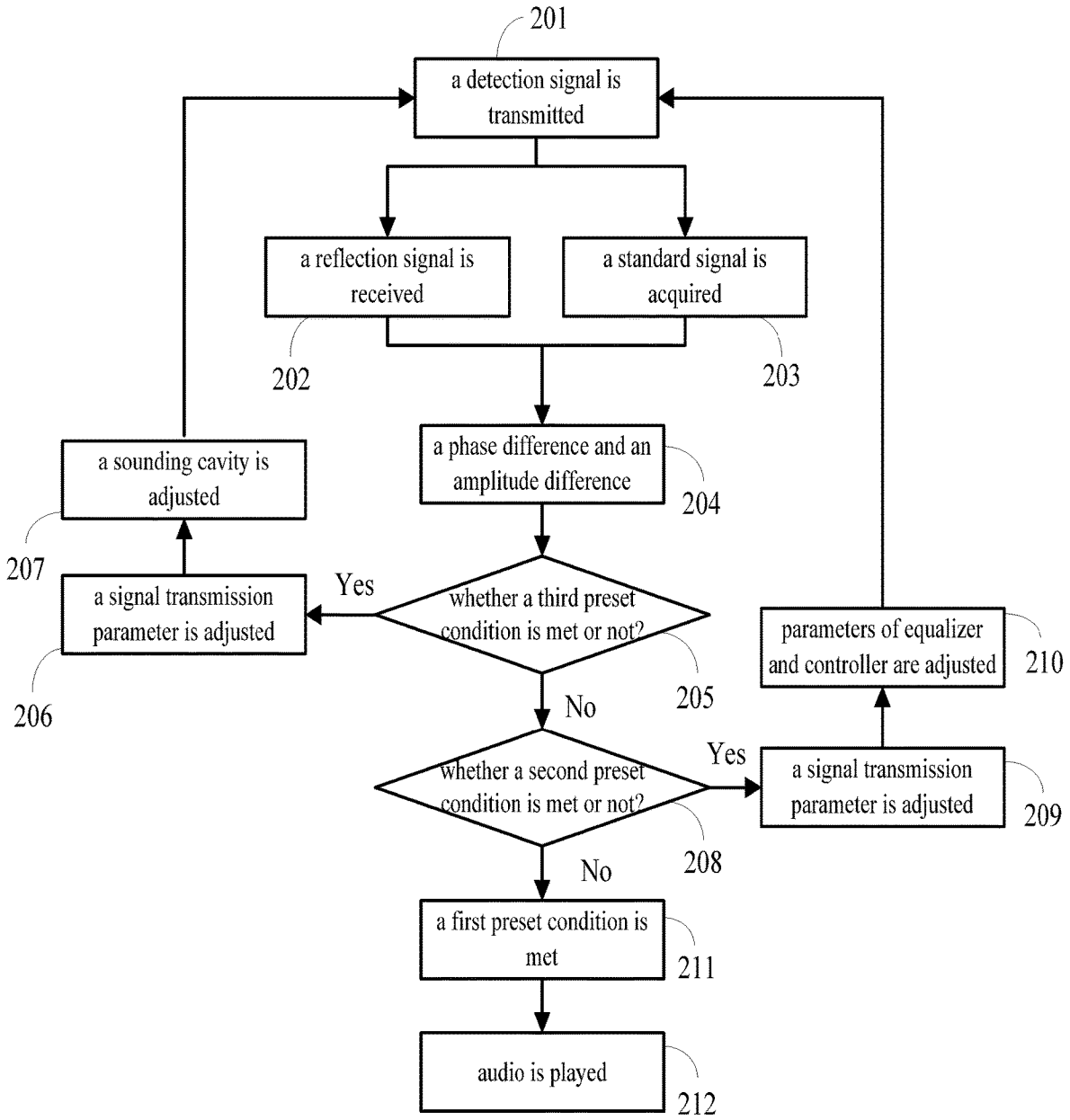
FIG. 2 is a flowchart of a method for determining a configuration parameter according to some other embodiments of the present disclosure.

As shown in FIG. 2, the method for determining the configuration parameter may include the following operations.

At block 201, the detection signal is transmitted into the ear of the user and to the signal receiver respectively.

At block 202, a reflection signal, that is formed after the detection signal is reflected by a characteristic structure of an ear of a user, is received by the signal receiver.

At block 203, the standard signal is acquired according to the detection signal received by the signal receiver.

Figure 3:
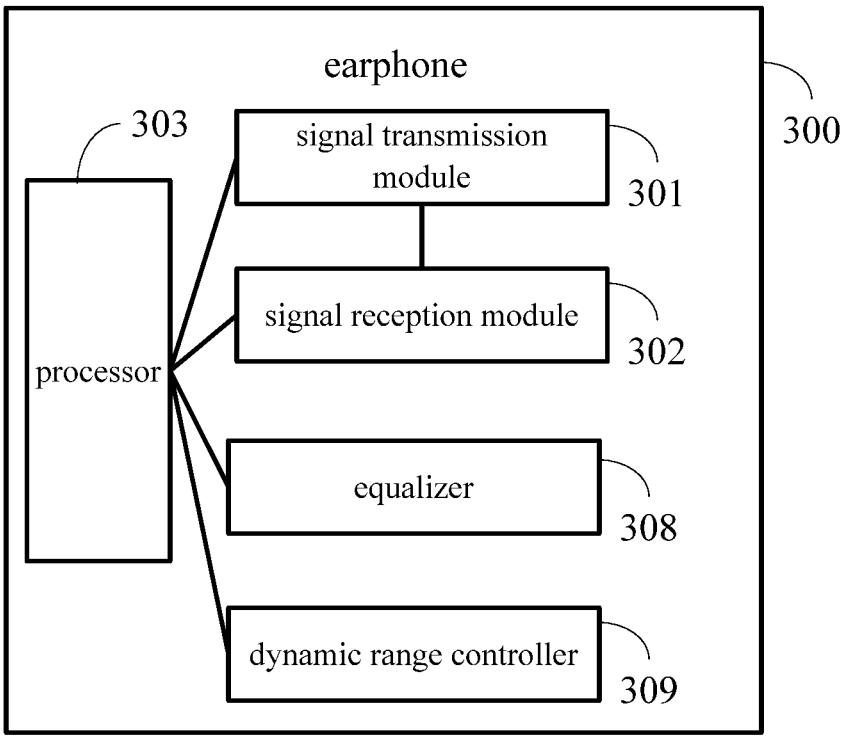
FIG. 3 is a block diagram of an earphone according to some embodiments of the present disclosure.

In this embodiment, as shown in FIG. 3, the present disclosure also provides an earphone 300. The earphone 300 may include a signal transmitter 301 and a signal receiver 302. The signal transmitter 301 may be configured to transmit a detection signal, for example, a millimetre-wave signal. The signal receiver 302 is connected to the signal receiver 301, and is configured to receive the reflection signal reflected by the characteristic structure of the ear of the user and the detection signal transmitted from the signal transmitter 301 to the signal receiver 302. The processor 303 of the earphone 300 may be respectively connected to the signal transmitter 301 and the signal receiver 302 to control the signal transmitter 301 to transmit the detection signal, and form the standard signal according to the detection signal received by the reception module 302.

Since the earphone 300 may generally include a left output channel and a right output channel, the signal transmitter 301 may include a left signal transmitter and a right signal transmitter, and the signal receiver 302 may include a left signal receiver and a right signal receiver. A signal difference between the reflection signal received by the left signal receptions module and the standard signal may be the same to or different from a signal difference between the reflection signal received by the right signal receiver and the standard signal, which is not limited herein.

At block 204, a phase difference and an amplitude difference between the reflection signal and the standard signal are acquired.

In this embodiment, the processor 303 may acquire the signal difference between the reflection signal and the standard signal. Since it takes a period of time to transmit the detection signal into the ear of the user and reflect the detection signal, there may be a phase difference between the reflection signal and the standard signal. Since energy attenuation may happens during the reflection of the detection signal, there may be an amplitude difference between the reflection signal and the standard signal. As described in the embodiments as shown in FIG. 2, the configuration parameter of the earphone 300 is determined according to the amplitude difference and the phase difference. In other embodiments, the configuration parameter of the earphone 300 may also be determined according to the amplitude difference or the phase difference, which is not limited herein.

At block 205, it is determined whether the amplitude difference and the phase difference meet a third preset condition.

In this embodiment, the third preset condition may include several different cases. In a first case, the amplitude difference meets an amplitude sub-condition of the third preset condition and the phase difference does not meet a phase sub-condition of the third preset condition. In a second case, the amplitude difference does not meet the amplitude sub-condition of the third preset condition and the phase difference meets the phase sub-condition of the third preset condition. In a third case, the amplitude difference does not meet the amplitude sub-condition of the third preset condition and the phase difference does not meet the phase sub-condition of the third preset condition. The amplitude sub-condition of the third preset condition may refer to an amplitude range, and the amplitude difference meeting the amplitude sub-condition of the third preset condition means that the amplitude difference falls within the amplitude range. Similarly, the phase sub-condition of the third preset condition may refer to a phase range, and the phase difference meeting the phase sub-condition of the third preset condition means that the phase difference falls within the phase range.

When the amplitude difference meets the amplitude sub-condition of the third preset condition and the phase difference meets the phase sub-condition of the third preset condition, an act of block 206 is performed. When the amplitude difference does not meet the amplitude sub-condition of the third preset condition and/or the phase difference does not meet the phase sub-condition of the third preset condition, an act of block 208 is performed.

At block 206, the signal transmission parameter is adjusted according to the amplitude difference and the phase difference.

At block 207, a volume of the sounding cavity is adjusted according to the signal transmission parameter.

In this embodiment, when the amplitude difference and the phase difference meet the third preset condition, a difference between a default configuration parameter of the earphone and a configuration parameter that is well-matched with a user is considered to be large. Therefore, in order to improve the efficiency of adaptation, the configuration parameter may be adjusted by adjusting a hardware structure of the earphone 300.

Figure 4:
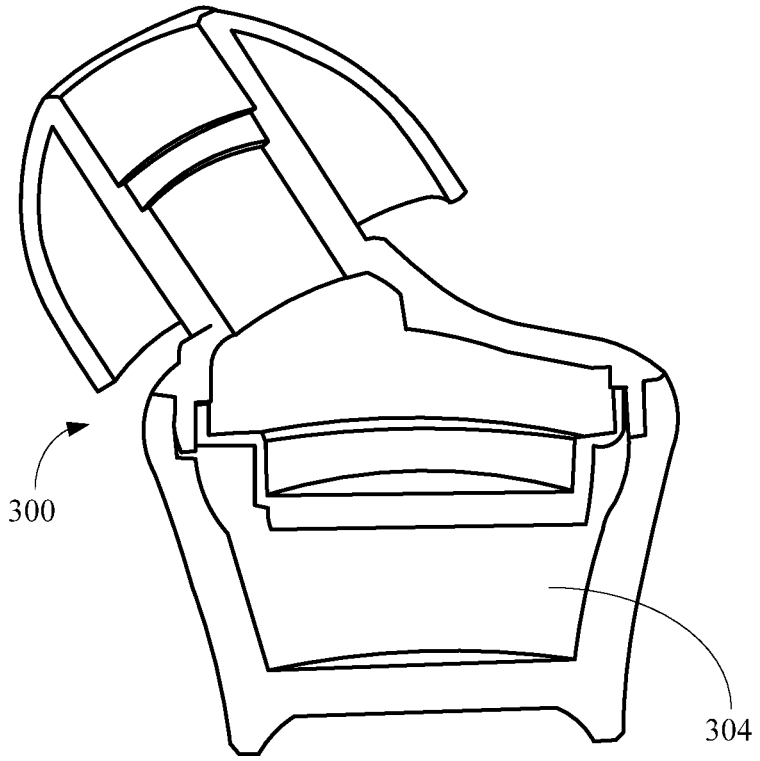
FIG. 4 is a schematic diagram of a cross-section of an earphone according to some embodiments of the present disclosure.

Specifically, the signal transmission parameter of the detection signal may be adjusted so that the signal difference between the reflection signal and the standard signal gradually decreases. Furthermore, there is a corresponding relationship between the signal transmission parameter and the volume of the sounding cavity 304 of the earphone 300 as shown in FIG. 4. A volume of the sounding cavity 304 corresponding to the adjusted signal transmission parameter may be queried according to the relationship, and then the volume of the sounding cavity 304 may be adjusted according to the queried volume.

Figure 5:
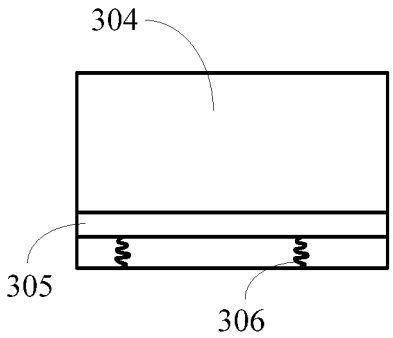
FIG. 5 is a schematic diagram of a state of a sounding cavity of an earphone according to some embodiments of the present disclosure.
Figure 6:
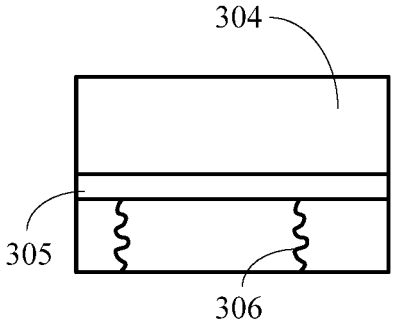
FIG. 6 is a schematic diagram of a state of a sounding cavity of an earphone according to some other embodiments of the present disclosure.

For example, as shown in FIGS. 4 to 6, the detection signal is assumed to have a first transmission parameter, the amplitude difference and the phase difference meet the third preset condition. In this case, the detection signal having a second transmission parameter is transmitted to reduce the amplitude difference and the phase difference, at the same time, the volume of the sounding cavity 304 may be adjusted in a manner as shown in FIG. 5 or 6 according to a volume of the sounding cavity 304 corresponding to the second transmission parameter. The adjustment may be performed in this way until the amplitude difference and the phase difference meet a second preset condition. In the embodiments as shown in FIGS. 5 and 6, the earphone 300 may further include a movable member 305 disposed in the sounding cavity 304 and a spring 306 connected to the movable member 305. As shown in FIG. 5 when the spring 306 is compressed, the movable member 305 may move from top to bottom to increase the volume of the sounding cavity 304, and when the spring 306 is reset as shown in FIG. 6, the movable member 305 may move from bottom to top to reduce the volume of the sounding cavity 304.

Figure 7:
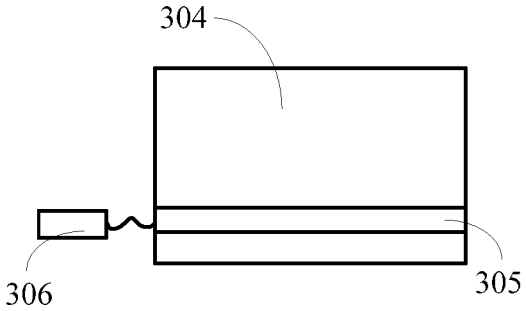
FIG. 7 is a schematic diagram of a state of a sounding cavity of an earphone according to yet some other embodiments of the present disclosure.
Figure 8:
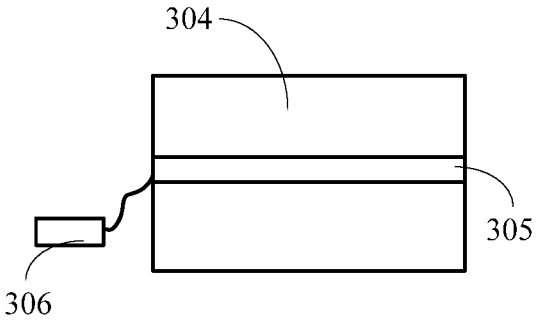
FIG. 8 is a schematic diagram of a state of a sounding cavity of an earphone according to a further embodiment of the present disclosure.

In some other embodiments, as shown in FIGS. 7 and 8, the earphone 300 may further include a movable member 305 and a motor assembly 307 disposed in the sounding cavity 304. The motor assembly 307 is connected to the movable member 305. As shown in FIG. 7, the motor assembly 307 may drive the movable member 305 to move from top to bottom to increase the volume of the sounding cavity 304. As shown in FIG. 8, the motor assembly 307 may drive the movable member 305 to move from bottom to top to reduce the volume of the sounding cavity 304.

At block 208, it is determined whether the amplitude difference and the phase difference meet the second preset condition.

In this embodiment, the second preset condition may include several different cases. In a first case, the amplitude difference meets an amplitude sub-condition of the second preset condition and the phase difference does not meet a phase sub-condition of the second preset condition. In a second case, the amplitude difference does not meet the amplitude sub-condition of the second preset condition and the phase difference meets the phase sub-condition of the second preset condition. In a third case, the amplitude difference does not meet the amplitude sub-condition of the second preset condition and the phase difference does not meet the phase sub-condition of the second preset condition. The amplitude sub-condition of the second preset condition may refer to an amplitude range, and the amplitude difference meeting the amplitude sub-condition of the second preset condition means that the amplitude difference falls within the amplitude range. Similarly, the phase sub-condition of the second preset condition may refer to a phase range, and the phase difference meeting the phase sub-condition of the second preset condition means that the phase difference falls within the phase range.

When the amplitude difference meets the amplitude sub-condition of the second preset condition and the phase difference meets the phase sub-condition of the second preset condition, an act of block 209 is performed. When the amplitude difference does not meet the amplitude sub-condition of the second preset condition and/or the phase difference does not meet the phase sub-condition of the second preset condition, an act of block 211 is performed.

At block 209, the signal transmission parameter is adjusted according to the amplitude difference and the phase difference.

At block 210, parameters of an equalizer and a dynamic range controller of the earphone are adjusted according to the signal transmission parameter.

In this embodiment, when the amplitude difference and the phase difference meet the second preset condition, a difference between a default configuration parameter of the earphone and a configuration parameter that is well-matched with a user is considered to be small. Therefore, in order to improve the efficiency of adaptation, the configuration parameter may be adjusted by adjusting a software parameter of the earphone 300.

Specifically, as shown in FIG. 3, the earphone 300 may include the equalizer 308 and the dynamic range controller 309. When a parameter of the equalizer 308 changes, a frequency of an output audio signal may be adjusted, and when a parameter of the dynamic range controller 309 changes, an amplitude of the output audio signal may be adjusted, so as to realize the adjustment of the audio response.

Specifically, the signal transmission parameter of the detection signal may be adjusted so that the signal difference between the reflection signal and the standard signal gradually decreases and the amplitude difference and the phase difference meet a first preset condition. Further, there is a corresponding relationship between, on one hand, the signal transmission parameter, and, on the other hand, the parameters of the equalizer 308 and the dynamic range controller 309, and thus parameters of the equalizer 308 and the dynamic range controller 309 corresponding to the adjusted signal transmission parameter may be queried according to the relationship, and then the equalizer 308 and the dynamic range controller 309 may be adjusted according to the queried parameters, so as to adjust the configuration parameter of the earphone 300.

At block 211, the amplitude difference and the phase difference meet the first preset condition.

In this embodiment, when the amplitude difference and the phase difference meet the first preset condition, the amplitude difference meets an amplitude sub-condition of the first preset condition and the phase difference meets a phase sub-condition of the first preset condition. In this case, the earphone 300 is configured to apply the configuration parameter corresponding to the current signal transmission parameter, so as to achieve an optimized sound quality for the current user.

At block 212, the configuration parameter of the earphone is finalized to play audio.

It should be noted that, in the embodiment shown in FIG. 2, after the detection signal is transmitted for the first time, it is assumed that the difference between the reflection signal and the standard signal meets the third preset condition, then meets the second preset condition by adjustment, and finally meets the first preset condition. It should be understood that in some embodiments, the acts in blocks 205 to 207 may be omitted, that is, after the detection signal is transmitted for the first time, the difference between the reflection signal and the standard signal meets the second preset condition. In this case, the parameters of the equalizer 308 and the dynamic range controller 309 may be adjusted to change the configuration parameter of the earphone 300. Similarly, in other embodiments, the acts in blocks 205 to 210 may be omitted, that is, after the detection signal is transmitted for the first time, the difference between the reflection signal and the standard signal meets the first preset condition. In this case, the configuration parameter of the earphone 300 may be the default parameter or a last configuration parameter.

Corresponding to the method for determining a configuration parameter as described above, the present disclosure provides in embodiments a device for determining a configuration parameter.

Figure 9:
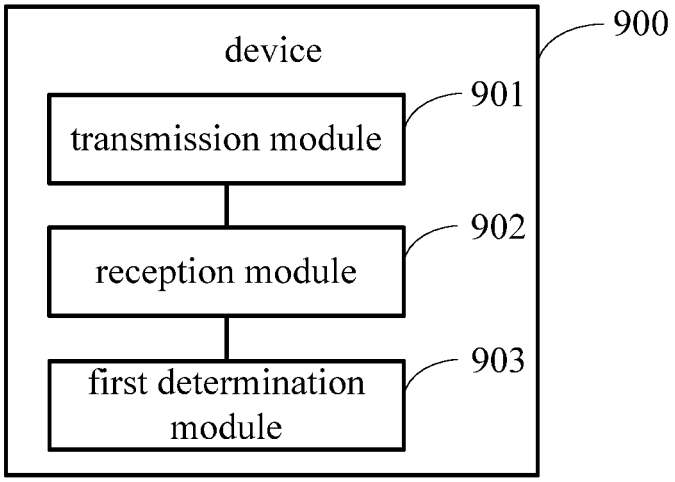
FIG. 9 is a block diagram of a device for determining a configuration parameter according to some embodiments of the present disclosure.

FIG. 9 is a block diagram of a device for determining a configuration parameter according to some embodiments of the present disclosure. Referring to FIG. 9, the device 900 is applied to a headset and includes a transmission module 901, a reception module 902, and a first determination module 903.

The transmission module 901 is configured to transmit a detection signal.

The reception module 902 is configured to receive a reflection signal formed after the detection signal is reflected by a characteristic structure of an ear of a user.

The first determination module 903 is configured to adjust a signal transmission parameter of the detection signal according to a signal difference between the reflection signal and a standard signal until the signal difference meets a first preset condition, to determine the configuration parameter of an earphone.

Figure 10:
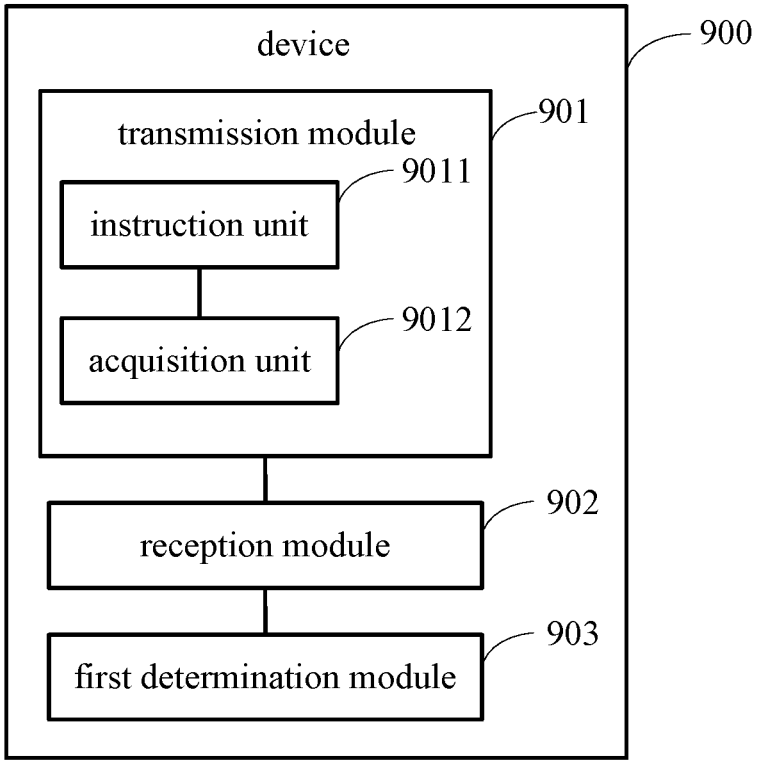
FIG. 10 is a block diagram of a device for determining a configuration parameter according to some other embodiments of the present disclosure.

FIG. 10 is a block diagram of a device for determining a configuration parameter according to some other embodiments of the present disclosure. As shown in FIG. 10, on the basis of the embodiment shown in FIG. 9, the earphone includes a signal transmitter 901 and a signal receiver 902, and the transmission module 901 includes an instruction unit 9011 and an acquisition unit 9012.

The instruction unit 9011 is configured to instruct the signal transmitter to transmit the detection signal into the ear of the user and to the signal receiver respectively.

The acquisition unit 9012 is configured to acquire the standard signal according to the detection signal received by the signal receiver.

Alternatively, the signal difference includes: a phase difference between the reflection signal and the standard signal; and/or an amplitude difference between the reflection signal and the standard signal.

Figure 11:
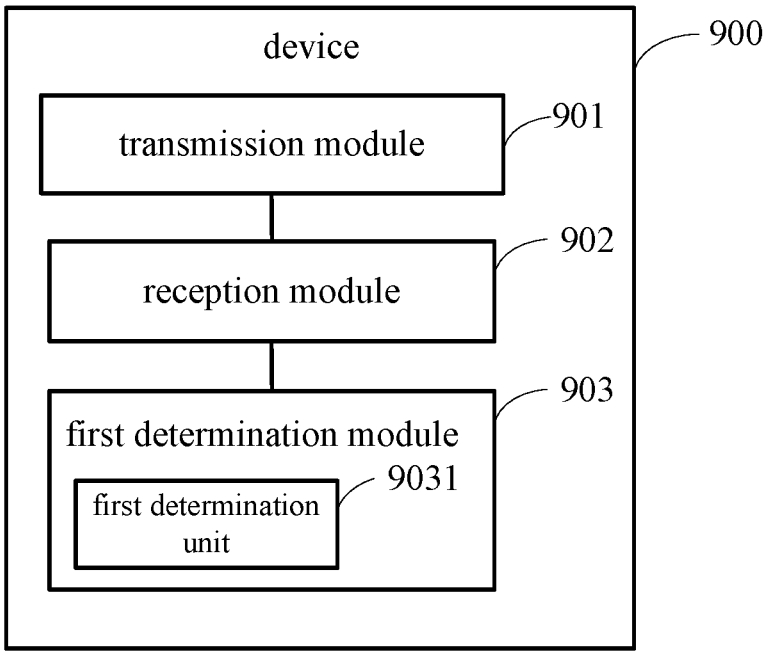
FIG. 11 is a block diagram of a device for determining a configuration parameter according to yet some other embodiments of the present disclosure.

FIG. 11 is a block diagram of a device for determining a configuration parameter according to a further embodiment of the present disclosure. As shown in FIG. 11, on the basis of the embodiment shown in FIG. 9, the first determination module 903 includes: a first determination unit 9031 configured to adjust the signal transmission parameter until the signal difference meets the first preset condition when the signal difference meets a second preset condition. In this case, parameters of an equalizer and a dynamic range controller of the earphone corresponding to the signal transmission parameter at a time when the first preset condition is met are determined as the configuration parameter of the earphone.

It should be noted that the structure of the first determination unit 9031 in the above embodiment of the device shown in FIG. 11 may also be included in the device shown in FIG. 10, which is not limited herein.

Figure 12:
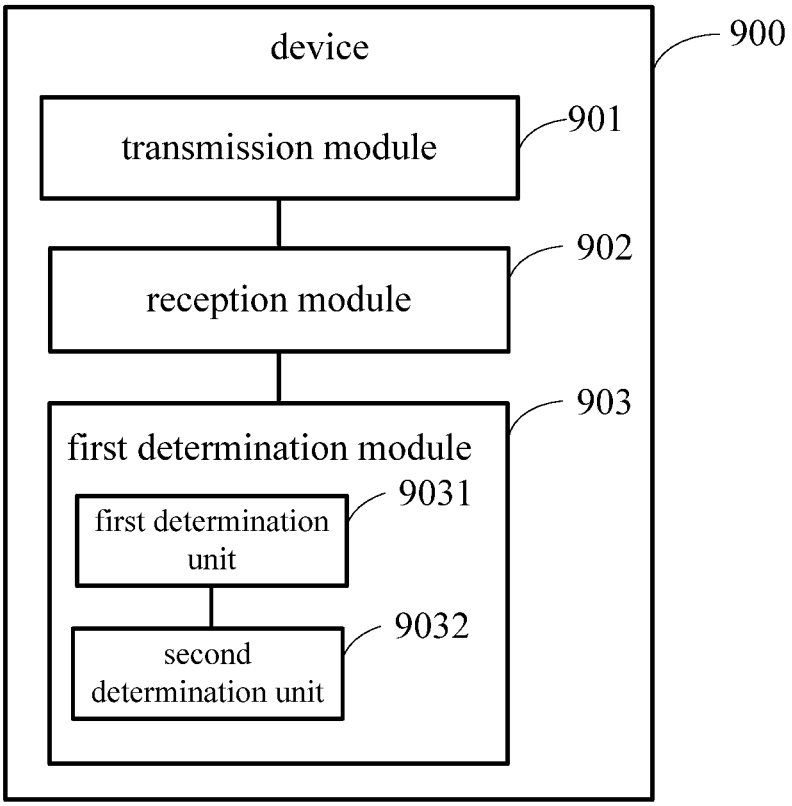
FIG. 12 is a block diagram of a device for determining a configuration parameter according to a further embodiment of the present disclosure.

FIG. 12 is a block diagram of a device for determining a configuration parameter according to still some other embodiments of the present disclosure. As shown in FIG. 12, on the basis of the embodiment shown in FIG. 11, the first determination module 903 further includes: a second determination unit 9032 configured to adjust the signal transmission parameter until the signal difference meets the second preset condition when the signal difference meets a third preset condition, wherein a volume of a sounding cavity of the earphone corresponding to the signal transmission parameter at a time when the second preset condition is met is determined as the configuration parameter of the earphone.

It should be noted that the structure of the first determination unit 9031 and the second determination unit 9032 in the above embodiment of the device shown in FIG. 12 may also be included in the device shown in FIG. 10, which is not limited herein.

Figure 13:
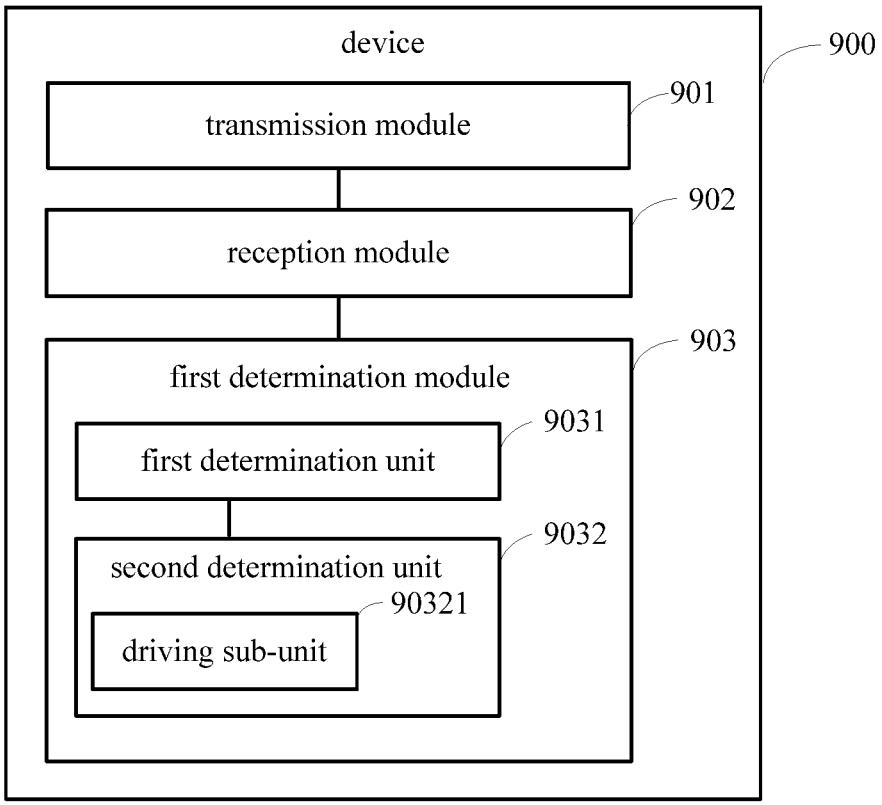
FIG. 13 is a block diagram of a device for determining a configuration parameter according to a further embodiment of the present disclosure.

FIG. 13 is a block diagram of a device for determining a configuration parameter according to a further embodiment of the present disclosure. As shown in FIG. 13, on the basis of the embodiment shown in FIG. 12, the second determination unit 9032 includes: a driving sub-unit 90321 configured to drive a movable member in the sounding cavity to move according to the signal transmission parameter to change the volume of the sounding cavity.

Figure 14:
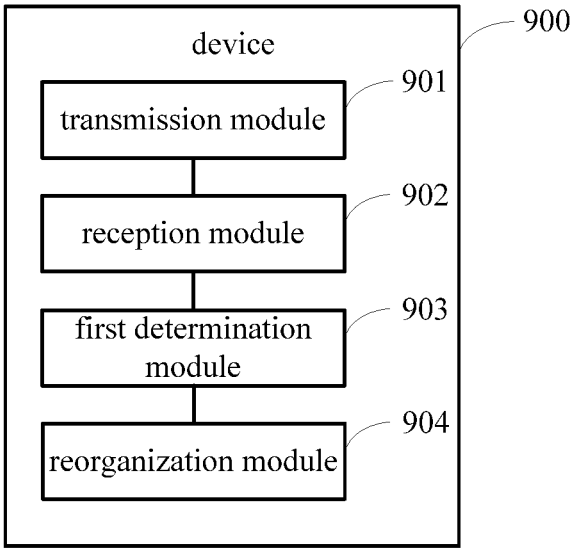
FIG. 14 is a block diagram of a device for determining a configuration parameter according to a further embodiment of the present disclosure.

FIG. 14 is a block diagram of a device for determining a configuration parameter according to a further embodiment of the present disclosure. As shown in FIG. 14, the device further includes: a reorganization module 904 configured to recognize an identity of the user according to the configuration parameter.

It should be noted that the structure of the reorganization module 904 in the above embodiment of the device shown in FIG. 14 may also be included in any device shown in FIGS. 10-13, which is not limited herein.

Figure 15:
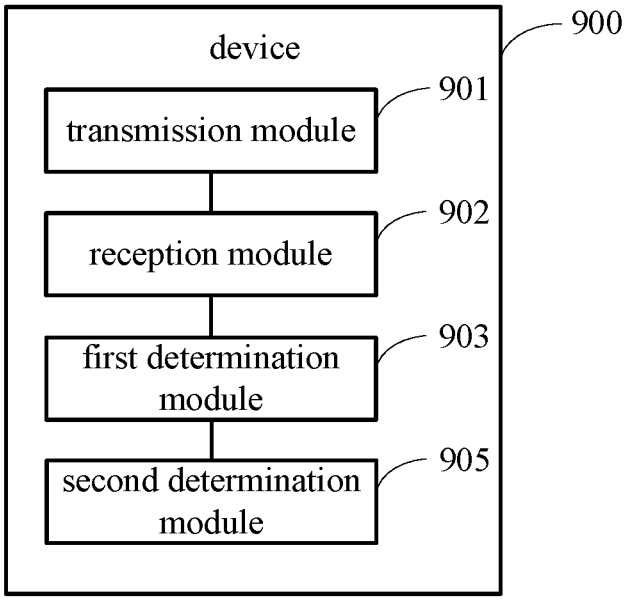
FIG. 15 is a block diagram of a device for determining a configuration parameter according to a further embodiment of the present disclosure.

FIG. 15 is a block diagram of a device for determining a configuration parameter according to a further embodiment of the present disclosure. As shown in FIG. 15, the device further includes: a second determination module 905 configured to determine a wearing state of the earphone according to whether the reflection signal is received or not.

It should be noted that the structure of the second determination module 905 in the above embodiment of the device shown in FIG. 15 may also be included in any device shown in FIGS. 10-14, which is not limited herein.

Alternatively, the detection signal includes a millimetre-wave signal.

Regarding the device in the above embodiment, details of operations for different components may refer to the content of the method in the embodiments as described above, which are not elaborated here again.

Details of the method embodiments may be applicable in the embodiments of the device of the present disclosure. The device embodiments described above are only illustrated. A unit described individually may or may not be a physically separated component. An element shown as a unit may or may not be a physical unit, that is, may be disposed at a place, or may be distributed to multiple network units. Some or all of the modules may be selected according to actual needs to achieve the objects of the present disclosure.

Accordingly, the present disclosure provides in embodiments a device for determining a configuration parameter, including a processor and a memory having a computer instruction stored therein. The processer is configured to execute the computer instruction in the memory for implementing a method for determining a configuration parameter including: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of an earphone.

Accordingly, the present disclosure provides in embodiments an earphone. The earphone includes a memory having a computer instruction stored therein; and a processor that is configured to execute the computer instruction in the memory for implementing a method for determining a configuration parameter including: transmitting a detection signal; receiving a reflection signal formed after the detection signal is reflected by a characteristic structure of an ear of a user; adjusting a signal transmission parameter of the detection signal according to a signal difference between the reflection signal and a standard signal until the signal difference meets a first preset condition, to determine the configuration parameter of the earphone.

Figure 16:
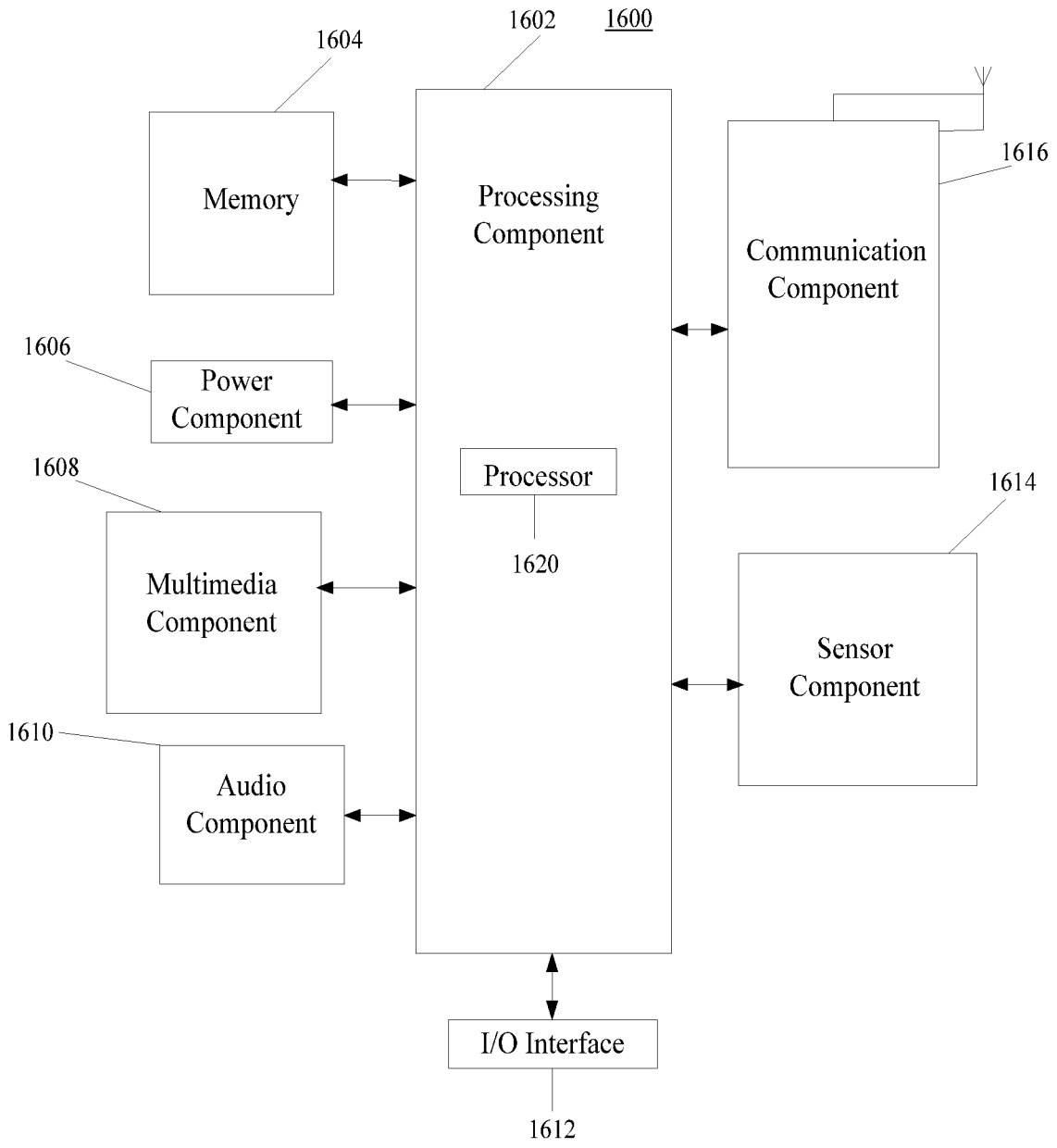
FIG. 16 is a block diagram of a device for determining a configuration parameter according to a further embodiment of the present disclosure.

FIG. 16 is a block diagram of a device for determining a configuration parameter according to some embodiments of the present disclosure. For example, the electronic device 1600 may be a mobile phone, a computer, a digital broadcast terminal, a messaging device, a game console, a tablet device, a medical device, an exercise device, a personal digital assistant, and the like.

Referring to FIG. 16, the device 1600 may include one or more of the following components: a processing component 1602, a memory device 1604, a power component 1606, a multimedia component 1608, an audio component 1610, an input/output (I/O) interface 1612, a sensor component 1614, and a communication component 1616.

The processing component 1602 normally controls the overall operation (such as operations associated with displaying, telephone calls, data communications, camera operations and recording operations) of the device 1600. The processing component 1602 may include one or a plurality of processors 1620 to execute instructions so as to perform all or part of the steps of the above described method. In addition, the processing component 1602 may include one or a plurality of modules to facilitate interactions among the processing component 1602 and other components. For example, the processing component 1602 may include a multimedia unit to facilitate interactions between the multimedia component 1608 and the processing component 1602.

The memory device 1604 is configured to store various types of data to support operations at the device 1600. Examples of such data include instructions for any application or method operated on the device 1600, contact data, phone book data, messages, images, videos and the like. The memory 1604 may be realized by any type of volatile or non-volatile storage devices, or a combination thereof, such as a static random access memory (SRAM), an electrically erasable programmable read only memory (EEPROM), an erasable programmable read only memory (EPROM), a programmable read only memory (PROM), a read only memory (ROM), a magnetic memory, a flash memory, a disk or an optical disk.

The power component 1606 provides power to various components of the device 1600. The power component 1606 may include a power management system, one or a plurality of power sources and other components associated with power generation, management, and distribution of the electronic device 1600.

The multimedia component 1608 includes a screen that provides an output interface between the device 1600 and the user. In some embodiments, the screen may include a liquid crystal display (LCD) and a touch panel (TP). In some embodiments, an organic light-emitting diode (OLED) display can be employed.

If the screen includes a touch panel, the screen may be implemented as a touch screen to receive input signals from the user. The touch panel includes one or a plurality of touch sensors to sense touches, slides, and gestures on the touch panel. The touch sensor may sense not only the boundary of the touches or sliding actions, but also the duration and pressure related to the touches or sliding operations. In some embodiments, the multimedia component 1608 includes a front camera and/or a rear camera. When the device 1600 is in an operation mode such as a shooting mode or a video mode, the front camera and/or the rear camera may receive external multimedia data. Each front camera and rear camera may be a fixed optical lens system or have a focal length and an optical zoom capability.

The audio component 1610 is configured to output and/or input an audio signal. For example, the audio component 1610 includes a microphone (MIC) that is configured to receive an external audio signal when the device 1600 is in an operation mode such as a call mode, a recording mode, and a voice recognition mode. The received audio signal may be further stored in the memory 1604 or transmitted via the communication component 1616. In some embodiments, the audio component 1610 further includes a speaker for outputting audio signals.

The I/O interface 1612 provides an interface between the processing component 1602 and a peripheral interface unit. The peripheral interface unit may be a keyboard, a click wheel, a button and so on. These buttons may include, but are not limited to, a home button, a volume button, a start button, and a locking button.

The sensor assembly 1614 includes one or a plurality of sensors for providing the device 1600 with various aspects of status assessments. For example, the sensor component 1614 may detect an open/closed state of the device 1600 and a relative positioning of the components. For example, the components may be a display and a keypad of the device 1600. The sensor component 1614 may also detect a change in position of the device 1600 or a component of the device 1600, the presence or absence of contact of the user with the device 1600, the orientation or acceleration/deceleration of the device 1600 and a temperature change of the device 1600. The sensor component 1614 may include a proximity sensor configured to detect the presence of nearby objects without any physical contact. The sensor component 1614 may also include a light sensor (such as a CMOS or a CCD image sensor) for use in imaging applications. In some embodiments, the sensor component 1614 may further include an acceleration sensor, a gyro sensor, a magnetic sensor, a pressure sensor, or a temperature sensor.

The communication component 1616 is configured to facilitate wired or wireless communication between the device 1600 and other devices. The device 1600 may access a wireless network based on a communication standard such as Wi-Fi, 2G or 3G, or a combination thereof. In some embodiments, the communication component 1616 receives broadcast signals or broadcast-associated information from an external broadcast management system via a broadcast channel. In some embodiments, the communication component 1616 further includes a near field communication (NFC) unit to facilitate short range communication.

In some embodiments, the device 1600 may be implemented by one or a plurality of application specific integrated circuits (ASICs), digital signal processors (DSPs), digital signal processing devices (DSPDs), programmable logic devices (PLDs), field programmable gate arrays (FPGA), controllers, microcontrollers, microprocessors, or other electronic components, so as to perform the above card data display method.

In some embodiments, there is also provided a non-transitory computer readable storage medium including instructions. When the above instructions are executed by the processor 1620 in the device 1600, the device 1600 may perform operations run in the method described in the above embodiments. For example, the non-transitory computer readable storage medium may be a ROM, a random-access memory (RAM), a CD-ROM, a magnetic tape, a floppy disk, an optical data storage device, etc.

In some embodiments, the earphone and the mobile terminal can be provided as an apparatus set. After coupling (e.g., pairing), some or all of the computational operations can be performed by one or more processing circuits of the mobile terminal through one or more applications (APPs), rather than by the processing circuit of the earphone, thereby further reducing the size of the earphone and/or prolonging battery life of the earphone.

The various device components, modules, units, circuits, sub-circuits, blocks, or portions may have modular configurations, or are composed of discrete components, but nonetheless can be referred to as "modules" in general. In other words, the "components," "modules," "units," "circuits," "sub-circuits," "blocks," or "portions" referred to herein may or may not be in modular forms, and these phrases may be interchangeably used.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HIVID) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A method for determining a configuration parameter of an earphone, comprising:

transmitting a detection signal;

receiving a reflection signal formed after the detection signal is reflected by a characteristic structure of an ear of a user; and adjusting a signal transmission parameter of the detection signal according to a signal difference between the reflection signal and a standard signal until the signal difference meets a first preset condition, to determine the configuration parameter, comprising:

adjusting the signal transmission parameter until the signal difference meets the first preset condition when the signal difference meets a second preset condition, wherein parameters of an equalizer and a dynamic range controller of the earphone corresponding to the signal transmission parameter at a time when the first preset condition is met are determined as the configuration parameter of the earphone.

2. The method of claim 1, wherein the earphone comprises a signal transmitter and a signal receiver, and the transmitting the detection signal comprises:

instructing the signal transmitter to transmit the detection signal into the ear of the user and to the signal receiver respectively; and acquiring the standard signal according to the detection signal received by the signal receiver.

3. The method of claim 1, wherein the signal difference comprises at least one of:

a phase difference between the reflection signal and the standard signal; and an amplitude difference between the reflection signal and the standard signal.

4. The method of claim 1, wherein the adjusting the signal transmission parameter of the detection signal according to the signal difference between the reflection signal and the standard signal until the signal difference meets the first preset condition, to determine the configuration parameter of the earphone further comprises:

adjusting the signal transmission parameter until the signal difference meets the second preset condition when the signal difference meets a third preset condition, wherein a volume of a sounding cavity of the earphone corresponding to the signal transmission parameter at a time when the second preset condition is met is determined as the configuration parameter of the earphone.

5. The method of claim 4, wherein the determination of the volume of the sounding cavity of the earphone corresponding to the signal transmission parameter at the time when the second preset condition is met as the configuration parameter of the earphone comprises:

driving a movable member in the sounding cavity to move according to the signal transmission parameter to change the volume of the sounding cavity.

6. The method of claim 1, further comprising:

recognizing an identity of the user according to the configuration parameter.

7. The method of claim 1, further comprising:

determining a wearing state of the earphone according to whether the reflection signal is received.

8. The method of claim 1, wherein the detection signal comprises a millimetre-wave signal.

9. A non-transient computer-readable storage medium having a computer instruction stored therein, wherein when the computer instruction is executed by a processor, the processor implements a method for determining a configuration parameter comprising:

transmitting a detection signal;

receiving a reflection signal formed after the detection signal is reflected by a characteristic structure of an ear of a user; and adjusting a signal transmission parameter of the detection signal according to a signal difference between the reflection signal and a standard signal until the signal difference meets a first preset condition, to determine the configuration parameter of an earphone, comprising:

adjusting the signal transmission parameter until the signal difference meets the first preset condition when the signal difference meets a second preset condition, wherein parameters of an equalizer and a dynamic range controller of the earphone corresponding to the signal transmission parameter at a time when the first preset condition is met are determined as the configuration parameter of the earphone.

10. An earphone, comprising:

a memory device having instructions stored therein; and a processor configured to execute the instructions to thereby implement operations of a method for determining a configuration parameter comprising:

transmitting a detection signal;

receiving a reflection signal formed after the detection signal is reflected by a characteristic structure of an ear of a user;

adjusting a signal transmission parameter of the detection signal according to a signal difference between the reflection signal and a standard signal until the signal difference meets a first preset condition, to determine the configuration parameter of the earphone, comprising:

adjusting the signal transmission parameter until the signal difference meets the first preset condition when the signal difference meets a second preset condition, wherein parameters of an equalizer and a dynamic range controller of the earphone corresponding to the signal transmission parameter at a time when the first preset condition is met are determined as the configuration parameter of the earphone.

11. The earphone of claim 10, wherein the earphone comprises:

a sounding cavity;

a movable member disposed in the sounding cavity and connected to the sounding cavity in a sliding manner.

12. The earphone of claim 10, wherein the earphone comprises a signal transmitter and a signal receiver, and transmitting the detection signal comprises:

instructing the signal transmitter to transmit the detection signal into the ear of the user and to the signal receiver respectively; and acquiring the standard signal according to the detection signal received by the signal receiver.

13. The earphone of claim 10, wherein the signal difference comprises at least one of:

a phase difference between the reflection signal and the standard signal; and an amplitude difference between the reflection signal and the standard signal.

14. The earphone of claim 10, wherein the adjusting the signal transmission parameter of the detection signal according to the signal difference between the reflection signal and the standard signal until the signal difference meets the first preset condition, to determine the configuration parameter of the earphone further comprises:

adjusting the signal transmission parameter until the signal difference meets the second preset condition when the signal difference meets a third preset condition, wherein a volume of the sounding cavity of the earphone corresponding to the signal transmission parameter at a time when the second preset condition is met is determined as the configuration parameter of the earphone.

15. The earphone of claim 14, wherein the determination of the volume of the sounding cavity of the earphone corresponding to the signal transmission parameter at the time when the second preset condition is met as the configuration parameter of the earphone comprises:

driving the movable member in the sounding cavity to move according to the signal transmission parameter to change the volume of the sounding cavity.

16. The earphone of claim 10, wherein the method further comprises:

recognizing an identity of the user according to the configuration parameter.

17. The earphone of claim 10, wherein the method further comprises:

determining a wearing state of the earphone according to whether the reflection signal is received;

wherein the detection signal comprises a millimetre-wave signal.

18. The earphone of claim 17, wherein the earphone is configured to:

determine both position and shape of the characteristic structure of the ear through the signal difference between the reflection signal and the standard signal;

further reduce the signal difference between the reflection signal and the standard signal by adjusting the signal transmission parameter;

upon that the signal difference is reduced to be sufficiently small, a configuration parameter corresponding to a current signal transmission parameter is determined as the configuration parameter of the earphone, to thereby adaptively adjust the configuration parameter according to the characteristics structure of the user's ear, optimizing the sound quality specific to the user;

wherein the earphone has a sounding cavity, and the earphone is configured to adjust a volume of the sounding cavity to adjust the configuration parameter through a spring in the sounding cavity compressed or extended according to the signal transmission parameter, and a movable member disposed in the sounding cavity driven by the spring to move to adjust the volume of the sounding cavity; and wherein the earphone is further configured to recognize an identification of the user based on the determined configuration parameter to thereby avoid the earphone being used by unauthorized users.

* * * * *